US010669790B2

(12) United States Patent
Berger et al.

(10) Patent No.: US 10,669,790 B2
(45) Date of Patent: Jun. 2, 2020

(54) PIPE RETAINING STRUCTURE

(71) Applicant: Ensco International Incorporated, Wilmington, DE (US)

(72) Inventors: Ryan Keith Berger, Magnolia, TX (US); Jerame Paul King, Houston, TX (US); Kari Nicole Sharp, Houston, TX (US); Juan Carlos Serna, Pearland, TX (US); John Nelson Royston, Jeanerette, LA (US); Justin Dow Alcorn, Houston, TX (US); Cristobal Pedro Forray, Richmond, TX (US); Karoline Bowen Jones, Houston, TX (US)

(73) Assignee: Ensco International Incorporated, Wilmington, DE (US)

( * ) Notice: Subject to any disclaimer, the term of this patent is extended or adjusted under 35 U.S.C. 154(b) by 0 days.

(21) Appl. No.: 16/034,111

(22) Filed: Jul. 12, 2018

(65) Prior Publication Data

US 2020/0018128 A1 Jan. 16, 2020

(51) Int. Cl.
*E21B 19/14* (2006.01)

(52) U.S. Cl.
CPC ..... *E21B 19/14* (2013.01)

(58) Field of Classification Search
CPC ..... E21B 19/14
See application file for complete search history.

(56) References Cited

U.S. PATENT DOCUMENTS

| | | | | | |
|---|---|---|---|---|---|
| 1,634,859 | A * | 7/1927 | Tibbetts | E21B 19/14 | 166/85.5 |
| 1,718,395 | A * | 6/1929 | Webb | E21B 19/14 | 211/70.4 |
| 2,094,506 | A * | 9/1937 | Umphres | E21B 19/14 | 211/70.4 |
| 2,148,058 | A * | 2/1939 | Clark | E21B 19/14 | 211/70.4 |
| 2,507,040 | A * | 5/1950 | Moore | E21B 19/14 | 211/70.4 |
| 2017/0260818 | A1* | 9/2017 | Berry | E21B 19/14 | |
| 2018/0321331 | A1* | 11/2018 | Finlay | E21B 23/04 | |

* cited by examiner

*Primary Examiner* — James G Sayre
(74) *Attorney, Agent, or Firm* — Fletcher Yoder, P.C.

(57) ABSTRACT

A device includes a base configured to be coupled to a storage segment of a pipe support assembly. The device also includes an arm configured to be coupled to the base. The arm is configured to provide lateral support to a pipe when the pipe is disposed in a storage area adjacent to a first portion of the storage segment. The arm is also configured to move in a horizontal direction from a first location in which an end of the arm is disposed at a first horizontal distance from the storage segment to a second location in which the end of the arm is disposed at second horizontal distance from the storage segment when a force greater than or equal to a predetermined level is applied to the arm.

18 Claims, 6 Drawing Sheets

PIPE RETAINING STRUCTURE

BACKGROUND

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Advances in the petroleum industry have allowed access to oil and gas drilling locations and reservoirs that were previously inaccessible due to technological limitations. For example, technological advances have allowed drilling of offshore wells at increasing water depths and in increasingly harsh environments, permitting oil and gas resource owners to successfully drill for otherwise inaccessible energy resources. Likewise, drilling advances have allowed for increased access to land based reservoirs.

Piping or pipes (e.g., tubular pipes such as drill pipes) may be utilized in conjunction with accessing oil and gas drilling locations. As depths of reservoirs increase, needs for additional piping to reach the reservoirs increase as well. Storage systems for the storage of the pipes increasingly are utilized to provide a storage location that allows for rapid access to pipes that are combined into a pipe string (e.g., a plurality of coupled pipes) to access a well and/or as a storage location for pipes that are being detached from the pipe string.

DETAILED DESCRIPTION

Figure 1:
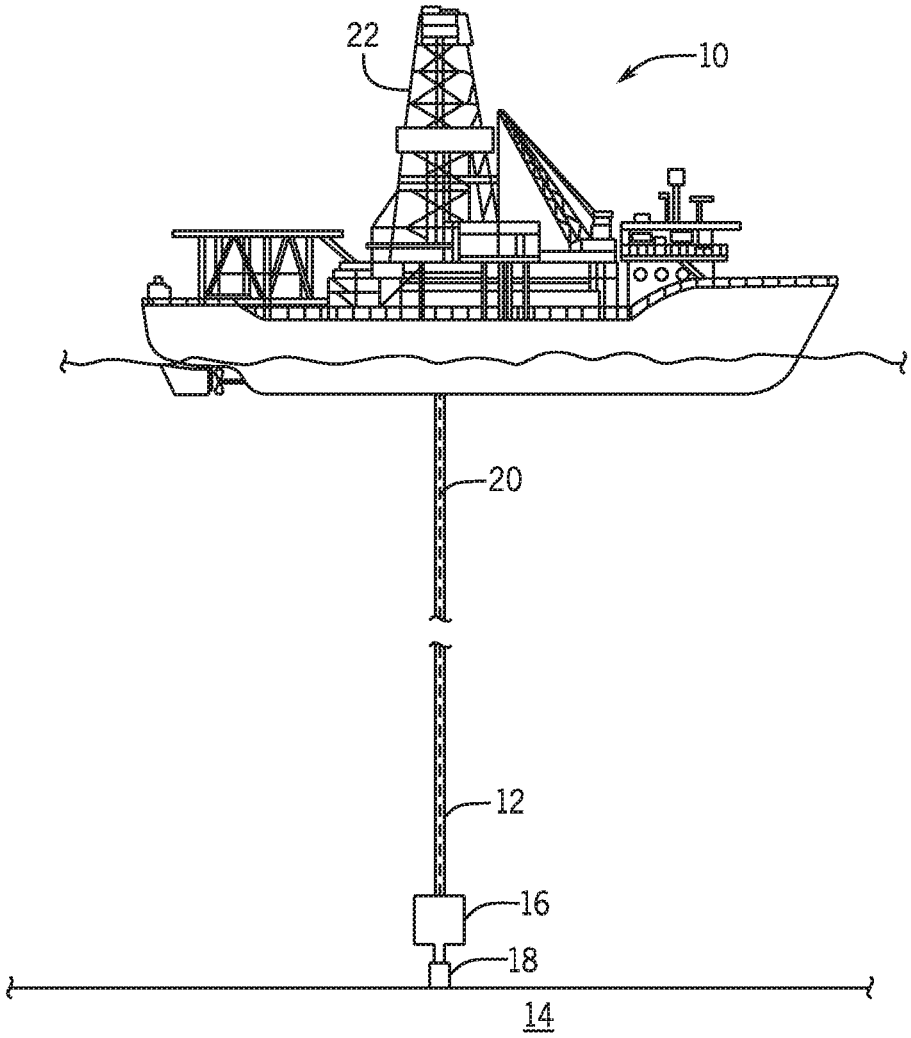
PRIOR ART FIG. 1
FIG. 1 illustrates an example of an offshore platform having a riser coupled to a blowout preventer (BOP), in accordance with an embodiment.

One or more specific embodiments will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments, the articles "a," "an," "the," and "said" are intended to mean that there are one or more of the elements. The terms "comprising," "including," and "having" are intended to be inclusive and mean that there may be additional elements other than the listed elements.

Oil and/or gas drilling operations on land and offshore utilize frequent movement of piping or pipes (e.g., which may be connected together as a pipe string) in and out of a well bore to facilitate the drilling operations. The pipes may be tubular in shape and, in some embodiments, may be drill pipes. The pipes may be mechanically coupled to one another and decoupled from one another as performed in various drilling operations. Storage systems may be employed to store the pipes in a particular location for ease of access. Present embodiments described herein are directed to components, systems, and techniques utilized in the storage of pipes used in oil and gas operations (e.g., drill pipes).

One such storage system may include a pipe support assembly which may, for example be a fingerboard, bellyboard, or monkeyboard. The pipe support assembly may be an upper, middle, or lower portion of the storage system that stores pipes vertically (e.g., in a vertical array). The pipe support assembly may store pipes along fixed and/or adjustable support segments (e.g., finger sections) and a pipe handling apparatus may operate to remove pipes from and/or place pipes into predetermined locations along the storage segments of the pipe support assembly. Typically, mechanical locking devices (e.g., latches) may engage the pipes to hold each individual pipe in position. The mechanical locking devices may be actively controlled to disengage, causing the mechanical locking device to move (e.g., actuate) from a first position in a storage region between parallel storage segments to a second position above a storage segment of the pipe support assembly so to allow the pipe handling apparatus to remove a stored pipe from the pipe support assembly across the storage region between parallel storage segments (e.g., across the area of the storage region in which the mechanical locking device was first positioned). Likewise, the mechanical locking devices may be actively controlled to be engaged (e.g., physically moved from the second position into the first position to allow the pipe handling apparatus to store a pipe in the pipe support assembly). In this manner, the mechanical locking devices operate as a horizontal support for vertically stored pipes that operate to move into and out of pipe storage space disposed between adjacent storage segments of a pipe support assembly (e.g., a fingerboard, bellyboard, monekyboard, or the like).

In other embodiments, the mechanical locking devices may be replaced with a pipe retaining member that differs structurally and/or operably from the aforementioned mechanical locking device. The pipe retaining member may be passively operated such that movement of the pipe across a face of the pipe retaining member (e.g., movement of the pipe via the pipe handling apparatus) causes the pipe retaining member to move from a first position in a storage region between parallel storage segments to a second position (e.g., in the storage region) to allow the pipe handling apparatus to remove a stored pipe from the pipe support assembly across the storage region between parallel storage segments (e.g., across the area of the storage region in which the pipe retaining member was first positioned). Additionally, the pipe retaining member may be resilient, such that once the pipe moves past the pipe retaining member in the second position, the pipe retaining member returns to the first position in the storage region.

With the foregoing in mind, FIG. 1 illustrates an offshore platform 10 as a drillship. Although the presently illustrated embodiment of an offshore platform 10 is a drillship (e.g., a ship equipped with a drilling system and engaged in offshore oil and gas exploration and/or well maintenance or completion work including, but not limited to, casing and tubing installation, subsea tree installations, and well capping), other offshore platforms 10 such as a semi-submersible platform, a jack-up platform, a spar platform, a floating production system, or the like may be substituted for the drillship. Indeed, while the techniques and systems described below are described in conjunction with a drillship, the techniques and systems are intended to cover at least the additional offshore platforms 10 described above. Likewise, while an offshore platform 10 is illustrated and described in FIG. 1, the techniques and systems described herein may also be applied to and utilized in onshore drilling activities. These techniques may also apply to at least vertical drilling or production operations (e.g., having a rig in a primarily vertical orientation drill or produce from a substantially vertical well) and/or directional drilling or production operations (e.g., having a rig in a primarily vertical orientation drill or produce from a substantially non-vertical or slanted well or having the rig oriented at an angle from a vertical alignment to respective to drill or produce from a substantially non-vertical or slanted well).

As illustrated in FIG. 1, the offshore platform 10 includes a riser string 12 extending therefrom. The riser string 12 may include a pipe or a series of pipes that connect the offshore platform 10 to the seafloor 14 via, for example, a BOP 16 that is coupled to a wellhead 18 on the seafloor 14. In some embodiments, the riser string 12 may transport produced hydrocarbons and/or production materials between the offshore platform 10 and the wellhead 18, while the BOP 16 may include at least one BOP stack having at least one valve with a sealing element to control wellbore fluid flows. In some embodiments, the riser string 12 may pass through an opening (e.g., a moonpool) in the offshore platform 10 and may be coupled to drilling equipment of the offshore platform 10. As illustrated in FIG. 1, it may be desirable to have the riser string 12 positioned in a vertical orientation between the wellhead 18 and the offshore platform 10 to allow a pipe string made up of pipes 20 to pass from the offshore platform 10 through the BOP 16 and the wellhead 18 and into a wellbore below the wellhead 18. Also illustrated in FIG. 1 is a drilling rig 22 (e.g., a drilling package or the like) that may be utilized in the drilling and/or servicing of a wellbore below the wellhead 18. Accordingly, present embodiments include the storage of pipes for use in oil and/or gas operations (e.g., vertically or at an incline, in the situation of directional or slant drilling) in which a pipe storage system may include a pipe retaining member that may operate to hold a pipe in a storage position.

Figure 2:
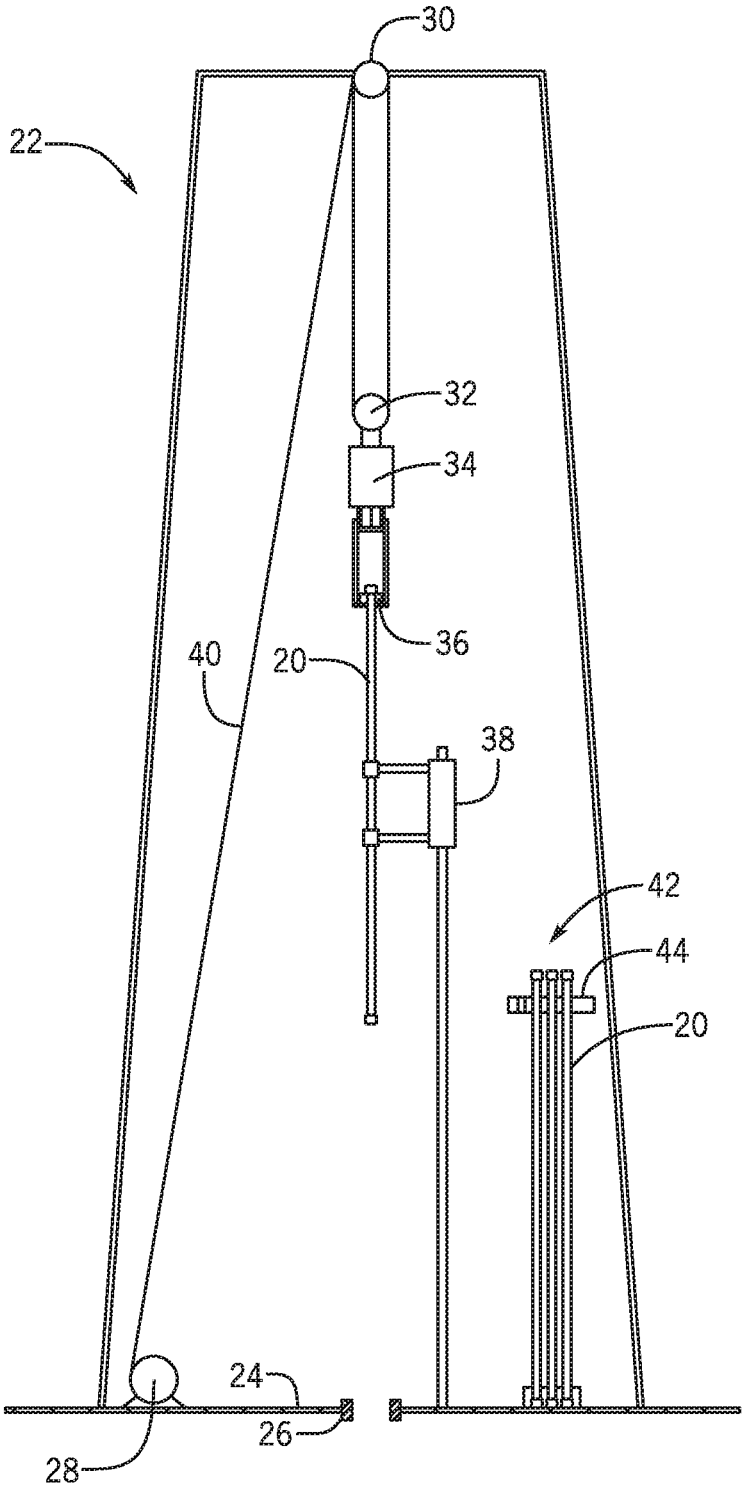
FIG. 2 illustrates a front view of a drill rig as illustratively presented in FIG. 1, in accordance with an embodiment.

One example of a system that utilizes stored pipe is depicted in FIG. 2. As illustrated, the drilling rig 22 may include a drill floor 24 disposed above the wellbore (e.g., the drilled hole or borehole of a well which may be proximate to the drill floor 24 in onshore operations or which may be, in conjunction with FIG. 1, below the wellhead 18 in offshore operations). The drilling rig 22 may perform operations in which tubulars (e.g., pipes 20) may be hoisted from or lowered into wellbore and, thus, may utilize a pipe storage system to hold the pipes to be disconnected or connected from a tubular (e.g., pipe) string.

As illustrated, the drilling rig 22 may also include one or more of floor slips 26 (e.g., to grip and hold a tubular such as pipe 20) and the drilling rig may utilize a roughneck or other device to facilitate the connection and disconnection of tubulars. The drilling rig may further include drawworks 28, a crown block 30, a travelling block 32, a top drive 34, an elevator 36, and a pipe handling apparatus 38. In some embodiments, a roughneck may operate to couple and decouple tubular segments or other pipe 20 (e.g., couple and decouple pipe 20 to and from a pipe string) while the floor slips 26 may operate to close upon and hold a pipe 20 and/or the drill string passing into the wellbore. The drawworks 28 may be a large spool that is powered to retract and extend drilling line 40 (e.g., wire cable) over a crown block 30 (e.g., a vertically stationary set of one or more pulleys or sheaves through which the drilling line 40 is threaded) and a travelling block 32 (e.g., a vertically movable set of one or more pulleys or sheaves through which the drilling line 40 is threaded) to operate as a block and tackle system for movement of the top drive 34, the elevator 36, and any pipe 20 (e.g., drill pipe) coupled thereto. In some embodiments, the top drive 34 and/or the elevator 36 may be referred to as a tubular support system or the tubular support system may also include the block and tackle system described above.

The top drive 34 may be a device that provides torque to (e.g., rotates) the drill string as an alternative to the a rotary and the elevator 36 may be a mechanism that may be closed around a pipe 20 or other tubular segments (or similar components) to grip and hold the pipe 20 or other tubular segments while those segments are moving vertically (e.g., while being lowered into or raised from a wellbore) or directionally (e.g., during slant drilling). The pipe handling apparatus 38 may operate to retrieve a pipe 20 and position the pipe 20 during operations (e.g., tripping operations) from a storage location (e.g., a pipe storage system 42, which may operate as a pipe stand or a pipe rack). The pipe handling apparatus 38 may also operate to retrieve a pipe 20 or other tubular segment from a pipe string or tubular string and transfer the pipe 20 or tubular segment to the pipe storage system 42 for storage therein. The pipe storage system 42 may include, for example, a pipe support assembly 44 that operates as a lateral support for portions of the stored pipes 20. The pipe support assembly 44 may be, for example, a fingerboard, bellyboard, a monkeyboard, or the like. Additionally, two or more pipe support assemblies 44 may be utilized at differing vertical heights above the drill floor 24 to provide lateral support at various points for the stored pipes 20.

Figure 3:
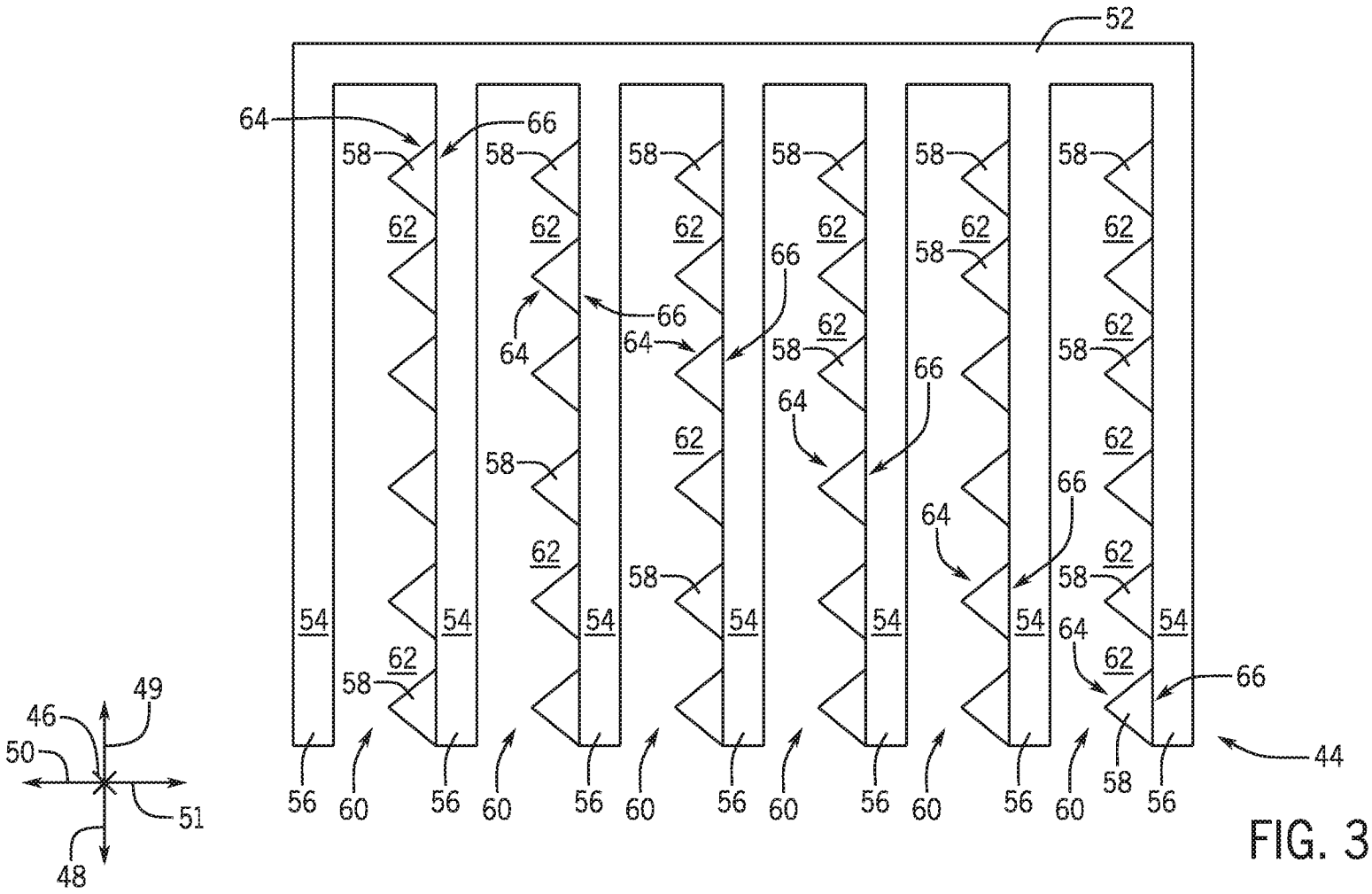
FIG. 3 illustrates a top view of a pipe support assembly of the pipe storage system of FIG. 2, in accordance with an embodiment.

FIG. 3 illustrates an example of the pipe support assembly 44 detailed from a top view. As illustrated, the pipe support assembly 44 (e.g., a fingerboard, a bellyboard, a monkeyboard, or the like) may operate as an upper portion of the pipe storage system 42 that stores pipes vertically (e.g., in a vertical array and in a vertical direction 46) and operates to provide lateral support (e.g., along at least horizontal directions 48 and 49 and/or in the horizontal plane associated with, for example, horizontal directions 48, 49, 50, and 51) to stored pipes 20 to maintain their positioning in the pipe support assembly 44. The pipe support assembly 44 may include a main body 52, storage segments 54 (e.g., fingers), an end section 56, and locking devices 58. The main body 52 may operate as a table or other support from which the storage segments 54 extend in the horizontal direction 48 (e.g., laterally from the main body 52). The storage segments 54 may be fixed and/or adjustable support segments or sections (e.g., finger sections) that may be organized in columns and may house or otherwise have attached thereto one or more locking devices 58. In some embodiments, an end section 56 without any associated locking devices 58 may be present in the pipe support assembly 44, for example, to operate as a support against a pipe 20 moving in the horizontal direction 48. For ease of explanation, horizontal directions 50 and 51 are additionally illustrated (such that a horizontal movement of the pipes 20 associated with horizontal directions 48, 49, 50, and 51 is envisioned). The storage segments 54 and/or the end section may form channels 60 (e.g., regions between parallel storage segments 54 and/or between a storage segment 54 and end section 56) that provide both a passage through which a pipe 20 may pass, for example, in horizontal direction 48 and horizontal direction 49, and storage areas 62 in which pipes 20 may be stored.

As previously noted, the pipe support assembly 44 may include locking devices 58. The locking devices 58 may be disposed along (and/or otherwise coupled to) respective storage segments 54. The locking devices 58 may be mechanical locking devices (e.g., latches) that may engage the pipes 20, such that two adjacent locking devices 58 may combine to provide lateral support (e.g., support in the horizontal place associated with horizontal directions 48 and 49) to an individual pipe 20 when in the pipe 20 is in a storage area 62. The locking devices 58 may be actively controlled to disengage (e.g., when the pipe handling apparatus 38 has gripped the pipe 20 to remove the pipe 20 from the pipe storage system 42), such that each respective locking device 58 moves (e.g., is actuated) from an engaged position 64 (e.g., storage position) in the channel 60 whereby the locking device 58 is located in the horizontal plane with the respective storage segment 54 coupled thereto. When actuated, the locking device 58 moves from the engaged position 64 into a disengaged position 66 horizontally outside of the channel 60, such that the locking device 58 is located in a vertical plane associated with vertical direction 46 and horizontal direction 51 with the respective storage segment 54 coupled thereto.

Sequential and individual activation of the locking devices 58 in a column by column manner along the respective storage segments 54 (i.e., activating the locking devices 58 of a storage segment 54 beginning with the locking device 58 disposed furthest from the main body 52 and subsequently activating locking devices 58 along the storage segment 54 in the horizontal direction 49 moving towards the main body 52) allows for individual pipes 20 to be removed from the pipe storage system 42 in a sequential manner by the pipe handling apparatus 38. The reverse process may be implemented to store pipes 20, whereby a locking device 58 of a storage segment 54 closest in proximity to the main body 52 is actively controlled to engage (if it has previously been disengaged) to move from the disengaged position 66 into the engaged position 64 (e.g., storage position) in the channel 60. The pipe handling apparatus 38 places the pipe 20 into storage area 62, a second locking device 58 located adjacent to the previously engaged locking device 58 is engaged to move from the disengaged position 66 into the engaged position 64 in the channel 60 and the pipe handling apparatus 38 may release the pipe 20 and retrieve another pipe 20 for storage in the pipe storage system 42.

Activation of the locking devices 58 may be accomplished via, for example, pneumatic control, which may include pneumatic components and associated control systems, as well as the associated cost and maintenance that accompanies the components and control systems. Additionally, if a locking device 58 fails to actuate, a pipe 20 may not be able to be retrieved or stored in the storage area 62 associated therewith, which can limit the operability of the pipe storage system 42 as well as recovery and/or storage of pipes 20 in the channel 60 having the failed locking device 58 therein. Accordingly, in some embodiments, replacement of the locking devices 58 with pipe retaining members may be undertaken. The operation of these pipe retaining members will be discussed in greater detail below.

Figure 4:
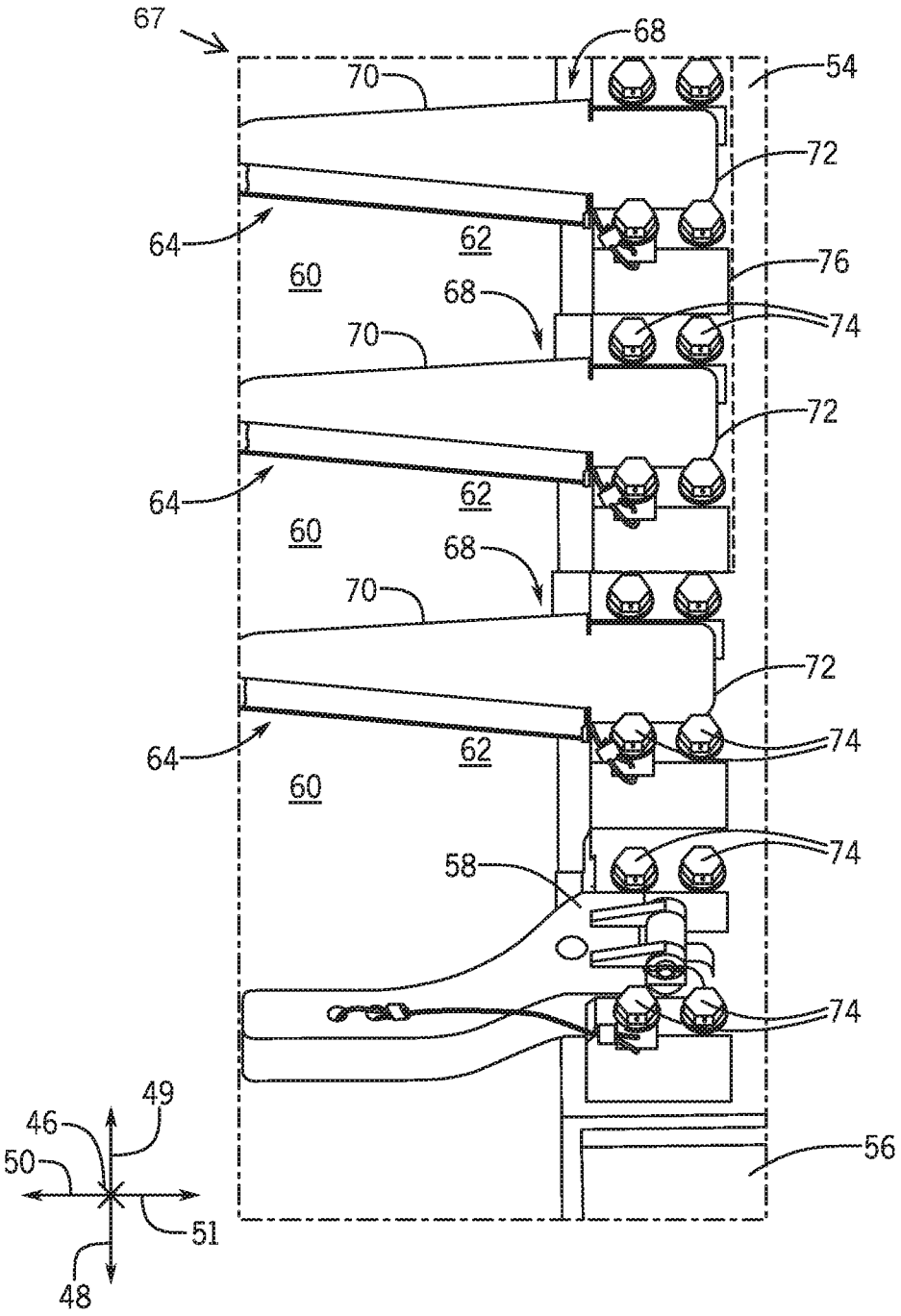
FIG. 4 illustrates a prospective view of a second embodiment of a pipe support assembly of the pipe storage system of FIG. 2, in accordance with an embodiment.

FIG. 4 illustrates a prospective view of a pipe support assembly 67 inclusive of pipe retaining members 68 that may be utilized in place of the locking devices 58 of FIG. 3. As illustrated, the pipe retaining members 68 may include an arm 70 that extends into channel 60 as well as a base 72 that is coupled to the storage segment 54. The arm 70 may be coupled to the base 72 as a single integrated member or as two distinct members and the arm may be made of the same or different material with respect to the base 72. As illustrated, in some embodiments, a locking device 58 may be utilized in a position furthest from the main body 52 (e.g., adjacent end section 56). In other embodiments, the illustrated locking device 58 may be disposed in a different location along the storage segment 54 and may be provided without any actuation system (i.e., so that the locking device 58 remains in an engaged position if, for example, the locking device 58 operates as final support proximate to main body 52). However, it may be appreciated that the locking device 58 of FIG. 4 may instead be replaced by a pipe retaining member 68.

In some embodiments, the pipe retaining members 68 (and the locking device 58, if utilized) may be individually coupled to the storage segment 54 via one or more fasteners 74 (e.g., bolts, pins, screws, and the like). In some embodiments, the fasteners 74 may be disposed in a horizontal direction 48 and 49 on either side of the respective pipe retaining member 68. In this manner, the one or more fasteners 74 may operate to allow for individual replacement of pipe retaining members 68 from the storage segment 54. In other embodiments, groups (e.g., two or more) of pipe retaining members 68 may be organized into a module 76 and the module 76 may be replaced from the storage segment 54 at the same time (allowing for two, three, . . . , or up to all of the pipe retaining members 68 to be replaced via replacement of the module 76, depending on the number of pipe retaining member 68 grouped into the module 76). When using a module 76, fasteners 74 between the module 76 and the storage segment 54 may be utilized in conjunction with the fasteners 74 of the pipe retaining members 68 and/or fasteners 74 of the pipe retaining members 68 may be omitted (i.e., the pipe retaining members 68 may be directly coupled via adhesive or the like to the module 76 so that the pipe retaining members 68 are not removable from the module 76 without damaging the pipe retaining members 68 while the module 76 may be removably coupled to the storage segment 54). When a module 76 is utilized, the locking device 58 may be a portion of the module 76. In other embodiments, the locking device 58 may be separately disposed in the storage segment 54 from any module(s) 76.

The pipe retaining members 68 may be passively operated. For example, the pipe retaining members 68 may be disposed in the channel 60 in an engaged position 64 (e.g., a storage position), whereby two adjacent pipe retaining members 68 each engage with a pipe 20 so as to combine to provide lateral support (e.g., support at least in directions 48 and 49) to an individual pipe 20 when the pipe 20 is in a storage area 62 (i.e., to restrict movement of the pipe 20). Additionally, the pipe retaining members 68 may be resilient, such that force greater than or equal to a predetermined level may be applied to move at least a portion of the pipe retaining member 68 and upon removal of the force greater than or equal to a predetermined level, the pipe retaining member 68 reverts to its original position (e.g., a storage position). For example, when a force greater than or equal to a predetermined level (e.g., sufficient to move the pipe retaining member 68) is applied by the pipe handling apparatus 38 to move the pipe 20 across a face of the pipe retaining member 68 adjacent to the pipe 20 (e.g., moving the pipe 20 in the horizontal direction 48 when removing the pipe 20 from the pipe support assembly 44), at least a portion of the pipe retaining member 68 is moved from the engaged position 64 into a movement position in which the arm 70 of the pipe retaining member 68 is disposed in a storage area 62 adjacent to the pipe retaining member 68. In this manner an end of the pipe retaining member 68 (e.g., a tip of the arm 70) furthest from the storage segment 54 is moved in horizontal distance closer to the storage segment 54. Thus, the pipe retaining member 68 is moved from an engaged position 64 into a storage area 62 adjacent to the pipe retaining member 68 in the horizontal direction 48 when the pipe 20 is being removed from the pipe storage system 42 or a storage area 62 adjacent to the pipe retaining member 68 in the horizontal direction 49 when the pipe 20 is being placed into the pipe storage system 42. As the pipe 20 is pulled past the pipe retaining member 68 and through the channel 60 (either in the horizontal direction 48 or the horizontal direction 49), the pipe retaining member 68 returns to its engaged position 64.

It is envisioned that the movement of the pipe retaining member 68 into the storage area 62 may include flex in the horizontal plane defined by horizontal directions 48, 49, 50, and 51 while retaining the resiliency of the pipe retaining member 68 (i.e., the pipe retaining member 68 returning the engaged position 64). Additionally and/or alternatively, the movement of the pipe retaining member 68 into the storage area 62 may include flex in the horizontal plane defined by horizontal directions 48, 49, 50, and 51 and the vertical plane, for example, defined by vertical direction 46 and one of horizontal directions 48 and 49 while retaining the resiliency of the pipe retaining member 68 (i.e., the pipe retaining member 68 returning the engaged position 64). Similarly in some embodiments, the pipe retaining member 68 may rotate about its affixed axis (i.e., along horizontal directions 48 and 49) while rotating (i.e., moving in the vertical plane defined by vertical direction 46 and, for example, one of horizontal directions 48 and 49) and/or flexing (i.e., moving in the horizontal plane defined by horizontal directions 48 and 49, 50, and 51) while retaining the resiliency of the pipe retaining member 68 (i.e., the pipe retaining member 68 returning the engaged position 64).

As described above, movement of the pipe 20 into and out of the pipe support assembly 44 and, accordingly, the pipe storage system 42, may be accomplished without the active control of any locking device 58 (when no locking devices 58 are present or through control of only one locking device 58, if utilized as an end locking member). This may provide advantages in that the system may be simpler (i.e., no need for locking device 58 control systems to control actuation of the locking devices 58 or only single locking device 58 control), cheaper (e.g., since pneumatic components are unnecessary), and may experience fewer failures that prevent usage of portions of the pipe storage system 42 (i.e., an unresponsive locking device in an engaged position 64, thus preventing access to a pipe 20 and/or a storage area 62). Additionally, the process for storing and retrieving pipe 20 form the pipe storage system 42 may be improved at least because, for example, one or more steps related to the control of particular locking devices 58, activation of the particular locking device 58, sensing and/or otherwise confirming that the locking device 58 has properly actuated may be omitted during pipe 20 retrieval and/or storage.

Figure 5:
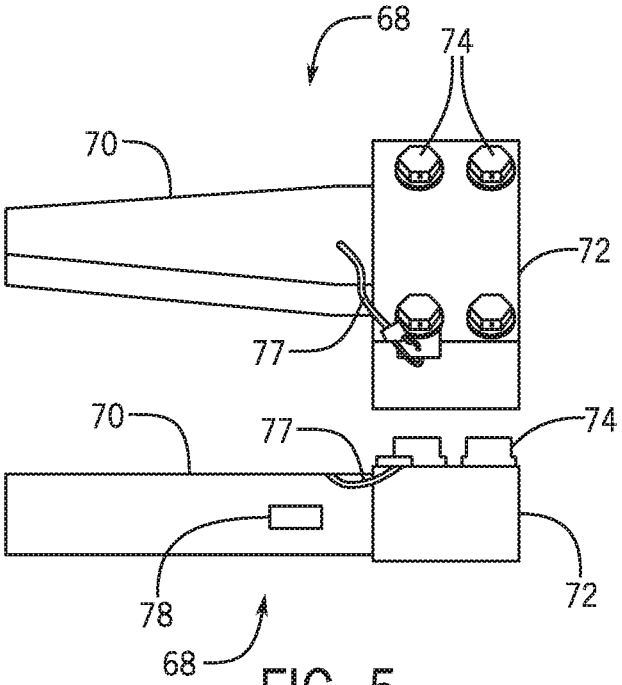
FIG. 5 illustrates a perspective and a side view of a pipe retaining member of FIG. 4, in accordance with an embodiment.

FIG. 5 illustrates a perspective and a side view of the pipe retaining member 68. In the illustrated embodiment, the one or more fasteners 74 may disposed in the base 72 and coupled to the storage segment 54 there through, whereby the arm 70 and the base 72 are a common material (e.g., a resilient material, such as rubber, natural polymers, synthetic polymers, and the like) and may be chosen to provide resistance to movement of the pipe 20 in the horizontal plane defined by horizontal directions 48, 49, 50, and 51 while being resilient when the pipe handling apparatus 38 provides a force of a sufficient threshold (e.g., a force greater than or equal to a predetermined level) to pass the pipe 20 along the pipe retaining member 68 by moving the pipe retaining member 68 in one of the directions 48 or 49). This is in contrast to the illustrated embodiment of FIG. 4, in which the fasteners 74 are coupled to material (metal or the like) of the base 72 that is the same material as used in the storage segment 54.

Also illustrated in FIG. 5 is a retention mechanism 77. The retention mechanism 77 may be affixed to each of the arm 70 and the base 72 and may operate to retain (i.e., hold) the arm 70 in a case of separation of the arm 70 from the base 72. In some embodiments, the retention mechanism 77 may be a wire (such as a braided wire) or another line that can support the weight of the arm 70 if it is separated from the base 72.

Additionally, one or more monitoring devices and/or systems may be utilized to monitor the usage of the pipe retaining members 68. For example, a strain detection device 78 may be implemented into the pipe retaining members. The strain detection device 78 may be, for example, a sensor, such as an integrated electroactive polymer (EAP), which operates to measure strain and deflection of the pipe retaining members 68 and transmits indications of the sensed results to a controller and/or a computing system that may indicate when and which pipe retaining members 68 should be replaced. Alternatively, the pipe handling apparatus 38 may be designed and/or programmed to operate with a known and repeatable force greater than or equal to a predetermined level to actuate the pipe retaining members 68. If a measured pressure feedback of the pipe handling apparatus 38 falls below a threshold value, this may cause the generation of an indication that one or more of the pipe retaining members 68 are ready for replacement. In this manner, the pipe handling apparatus 38 can monitor a change over time of the pressure exerted to move the pipe retaining members 68 and can, for example, determine the remaining life of the pipe retaining members 68 (as well as, for example, provide an indication of the remaining life) and/or provide an indication to replace one or more pipe retaining members 68 or modules 76.

Additionally, strain detection device 78 may include (separate from or in addition to the EAP), for example, a conductive plate that can be measured (i.e., via a meter or another detector) to determine remaining usefulness of the pipe retaining members 68 and/or their arms 70. The meter or detector may provide, for example, an indication of the remaining life of the pipe retaining member 68 and/or provide an indication to replace one or more pipe retaining members 68 and/or the arm 70 (if, for example, it is separable from the base 72) if the measured value is below a predetermined threshold. Alternatively, a control system (e.g., for the pipe handling apparatus 38 and/or in a driller's cabin that may provide a centralized control system for drilling controls, automated pipe handling controls, and the like) can be utilized to maintain and provide cycle counts based upon the number of pipes 20 entered into the pipe support assembly 44. Predetermined life-cycle counts could be used in the control system to provide, for example, an indication of the remaining life of one or more pipe retaining members 68 and/or provide an indication to replace one or more pipe retaining members 68 if the life-cycle count is outside a predetermined threshold.

Figure 6:
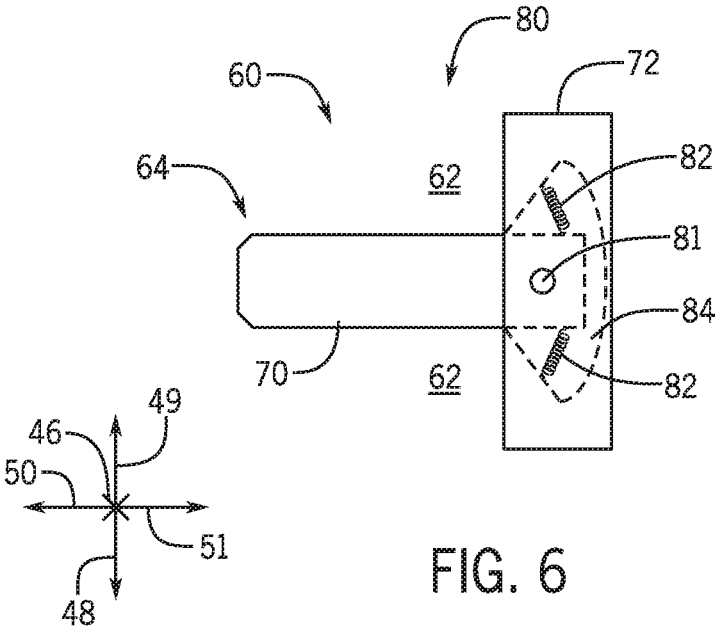
FIG. 6 illustrates a top view of a second embodiment of a pipe retaining member, in accordance with an embodiment.

FIG. 6 illustrates a top view of another embodiment of a pipe retaining member 80 that may be utilized in place of the locking devices 58 of FIG. 3 and/or the pipe retaining members 68 of FIGS. 4 and 5. The pipe retaining member 80 utilizes a fastener 81 about which the pipe retaining member 80 may rotate and one or more passive tension devices 82, such as springs, a flexible polymer, or other similar components that allow for resilient flex. As illustrated, the arm 70 may be coupled to the base 72 via the fastener 81 (e.g., a pin, or the like) that allows for movement of the arm 70 in the horizontal plane defined by horizontal directions 48, 49, 50, and 51 about the fastener 81 (i.e., allowing for movement of the arm 70 within cavity 84 internal to the base 72). This movement may include, for example, rotating movement (i.e., movement in the vertical plane defined by vertical direction 46 and at least one of horizontal directions 48 and 49) and/or flexing (i.e., movement in the horizontal plane defined by horizontal directions 48, 49, 50, and 51). Tension devices 82 may provide resistance to the movement of the arm 70 so as to provide support against a pipe 20 moving in the horizontal direction 48 and 49 when in an engaged position 64 (as illustrated in FIG. 6).

The pipe retaining member 80 may be passively operated. For example, the pipe retaining member 80 (along with an adjacent pipe retaining member 80) may be disposed in the channel 60 in an engaged position 64, whereby two adjacent pipe retaining members 80 each engage with a pipe 20 so as to combine to provide lateral support (e.g., horizontal support at least in horizontal directions 48 and 49) to an individual pipe 20 when in the pipe 20 is in a storage area 62 (i.e., to restrict movement of the pipe 20). Additionally, the pipe retaining members 80 may be resilient via the force provided by at least one of the tension devices 82 (e.g., a tension force to cause the pipe retaining member 80 to return to the engaged position 64), whereby the tension force provided by a tension device may be countered by an equal but opposite tension force from a second tension device 82 or by reductions of the tension force applied by the first tension device 82 as the pipe retaining member 80 returns to the engaged position 64 (e.g., if no second tension device 82 is coupled to the pipe retaining member 80).

For example, when a force (sufficient to move the pipe retaining member 80) is applied by the pipe handling apparatus 38 to move the pipe 20 across a face of the pipe retaining member 80 adjacent to the pipe 20 (e.g., moving the pipe 20 in the horizontal direction 53), at least a portion of the pipe retaining member 80 is moved from the engaged position 64 into a movement position in which the arm 70 of the pipe retaining member 80 is disposed in a storage area 62 adjacent to the pipe retaining member 80 (i.e., a storage area 62 adjacent to the pipe retaining member 80 in the horizontal direction 49 when the pipe 20 is being removed from the pipe storage system 42 or a storage area 62 adjacent to the pipe retaining member 80 in the horizontal direction 48 when the pipe 20 is being placed into the pipe storage system 42). In this manner an end of the pipe retaining member 80 (e.g., a tip of the arm 70) furthest from the storage segment 54 is moved in horizontal distance closer to the storage segment 54. As the pipe 20 is pulled past the pipe retaining member 80 and through the channel 60 (either in the horizontal direction 48 or the horizontal direction 49), at least one of the tension devices 82 provides a force to return the pipe retaining member 80 to its engaged position 64. In this manner, the pipe retaining member 80 need not be made of resilient material (e.g., may be made of non-resilient material, such as metal), but can still operate in a resilient manner similar to that described above with respect to FIG. 4. This may allow for the use of additional materials (e.g., non-resilient materials, such as metals, hard plastics, etc.) not traditionally considered to be resilient materials when constructing the pipe retaining member 80 of FIG. 6 while operating to achieve a similar result to resilient material pipe retaining members 68 of FIG. 4. One or more of the monitoring systems and techniques discussed above may also be applied to the monitoring of the pipe retaining member 80 of FIG. 6.

Figure 7:
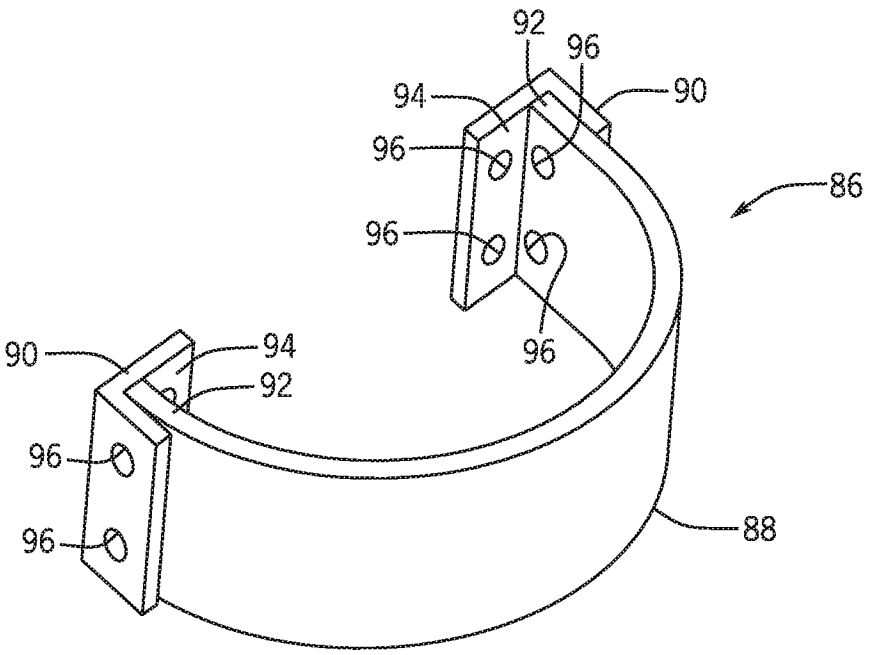
FIG. 7 illustrates a perspective view of a third embodiment of a pipe retaining member, in accordance with an embodiment.

FIG. 7 illustrates a perspective of a pipe retaining member 86 that may be utilized in place of the locking devices 58 of FIG. 3 and/or the pipe retaining members 68 of FIGS. 4-6. As illustrated, the pipe retaining member 86 may include an arm 88, which may be a retaining member such as a latch, a bumper, a flexible retainer, or the like. The arm 88 may have a curved surface such that the pipe retaining member 86 is circular or semi-circular in shape. The arm 88 and/or the pipe retaining member 86 may be made from a flexible and resilient material, such as rubber, natural polymers, synthetic polymers, and the like, which may be chosen to provide resistance to movement of the pipe 20 in the horizontal plane defined by horizontal directions 48, 49, 50, and 51 while being resilient when the pipe handling apparatus 38 provides a force of a sufficient threshold to pass the pipe 20 along the pipe retaining member 86 by moving the pipe retaining member 68 in direction 48 or 49. The arm 88 may be coupled to a support 90, such as a bracket or the like. In some embodiments, the support 90 may be made from a resilient material that may be the same as or different than the material used in the arm 88.

As illustrated, the arm 88 may be coupled to the support 90 at a location along a curved portion 92 of the arm 88. Additionally and/or alternatively, the pipe retaining member 86 may be coupled to the support 90 at a location along a base 94 of the pipe retaining member 86 that extends from the curved portion 92 of the arm 88. The arm 88 may be coupled to the base 94 as a single integrated member or as two distinct members and the arm 88 and the base 94 may be made of the same material or differing materials. One or more fasteners 96 (e.g., bolts, pins, screws, and the like) may be utilized to couple the arm 88 to the support 90 and/or to couple the base 94 to the support 90. Additionally, the support 90 may itself be coupled to a storage segment 54 or a module 76 via an adhesive, a fastener, or the like. In one embodiment, the one or more fasteners 96 along the base 94 of the pipe retaining member 86 may couple both the pipe retaining member 86 and the support 90 to, for example, a storage segment 54 or a module 76.

Figure 8:
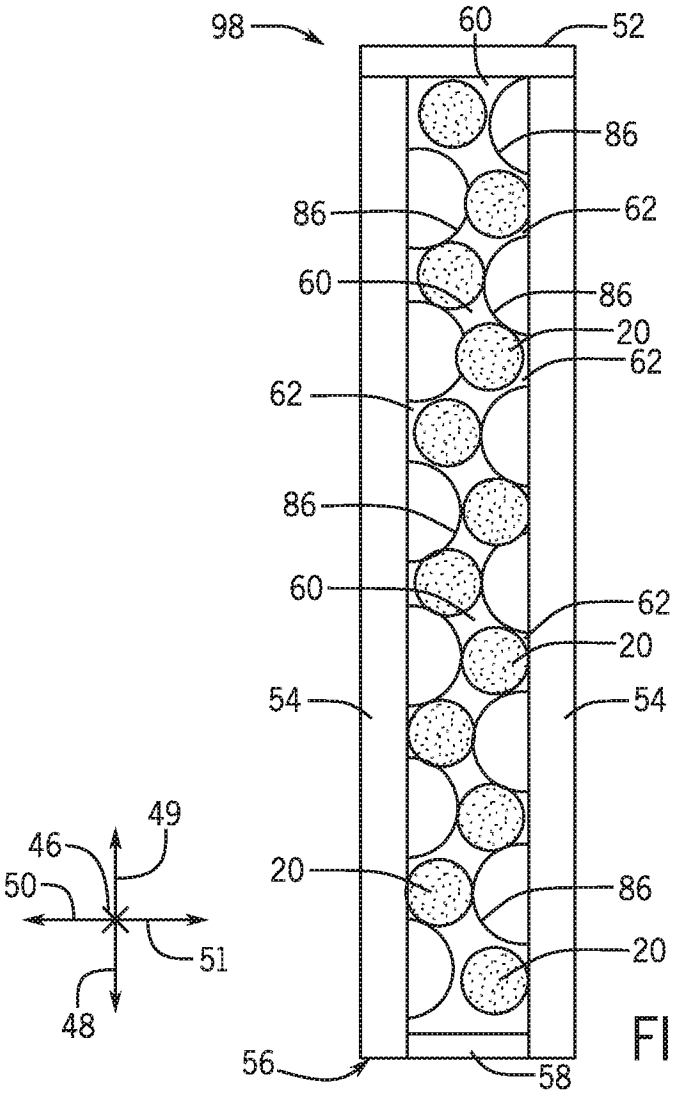
FIG. 8 illustrates a top view of a third embodiment of a pipe support assembly of the pipe storage system of FIG. 2 inclusive of the pipe retaining members of FIG. 7, in accordance with an embodiment.

FIG. 8 illustrates a top view of a pipe support assembly 98 inclusive of pipe retaining members 86. As illustrated, the pipe retaining members 86 may extend into the channel 60 and may provide support for pipes 20 (e.g., may resist movement of the pipes 20 in at least horizontal directions 48 and 49). The pipe retaining members 86 may be passively operated. For example, the pipe retaining members 86 may be disposed in the channel 60, whereby two adjacent pipe retaining members 86 each engage with a pipe 20 so as to combine to provide lateral support (e.g., support at least in directions 48 and 49) to an individual pipe 20 when the pipe 20 is in a storage area 62 (i.e., to restrict movement of the pipe 20). Additionally, the pipe retaining members 86 may be resilient, such that force may be applied to move at least a portion of the pipe retaining member 86, for example, directions 50 or 51, 48, and/or 49 (depending on the force provided by the pipe handling apparatus 38) and upon removal of the force, the pipe retaining member 86 reverts to its original position. For example, when a force (sufficient to move the pipe retaining member 86) is applied by the pipe handling apparatus 38 to move the pipe 20 across a face of the pipe retaining member 86 adjacent to the pipe 20 (e.g., moving the pipe 20 in the horizontal direction 48 when removing the pipe 20 from the pipe support assembly 98), at least a portion of the pipe retaining member 86 is moved from an engaged position, for example, towards the storage segment 54 coupled to the pipe retaining member 86 (e.g., in a horizontal direction 50 when the pipe retaining member 86 is coupled to the leftmost illustrated storage segment 54 or in a horizontal direction 51 when the pipe retaining member 86 is coupled to the rightmost illustrated storage segment 54). In this manner an end of the pipe retaining member 86 (e.g., an outermost portion of the arm 88 away from supports 90) furthest from the storage segment 54 is moved in horizontal distance closer to the storage segment 54. This movement of the pipe retaining member 86 may be resilient movement that allows the pipe retaining member 86 to return to its illustrated form of FIG. 8 when the pipe 20 has passed the arm 88 of a particular pipe retaining member 86.

It is envisioned that the movement of the pipe retaining member 86 may include flex in the horizontal plane defined by horizontal directions 48, 49, 50, and 51 while retaining the resiliency of the pipe retaining member 86 (i.e., the pipe retaining member 86 returning the position illustrated in FIG. 8). Additionally and/or alternatively, the movement of the pipe retaining member 86 may include flex in the horizontal plane defined by horizontal directions 48, 49, 50, and 51 and the vertical plane, for example, defined by vertical direction 46 and one of horizontal directions 48 and 49 while retaining the resiliency of the pipe retaining member 86 (i.e., the pipe retaining member 86 returning the position illustrated in FIG. 8).

As described above, movement of the pipe 20 into and out of the pipe support assembly 98 and, accordingly, the pipe storage system 42, may be accomplished without the active control of any locking device 58 (when no locking devices 58 are present or through control of only one locking device 58, if utilized as an end lock member). This may provide advantages in that the system may be simpler (i.e., no need for locking device 58 control systems to control actuation of the locking devices 58), cheaper (e.g., since pneumatic components are unnecessary), and may experience fewer failures that prevent usage of portions of the pipe storage system 42 (i.e., an unresponsive locking device in an engaged position 64, thus preventing access to a pipe 20 and/or a storage area 62). Additionally, the process for storing and retrieving pipe 20 form the pipe storage system 42 may be improved at least because, for example, one or more steps related to the control of particular locking devices 58, activation of the particular locking device 58, sensing and/or otherwise confirming that the locking device 58 has properly actuated may be omitted during pipe 20 retrieval and/or storage.

This written description uses examples to disclose the above description to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims. Accordingly, while the above disclosed embodiments may be susceptible to various modifications and alternative forms, specific embodiments have been shown by way of example in the drawings and have been described in detail herein. However, it should be understood that the embodiments are not intended to be limited to the particular forms disclosed. Rather, the disclosed embodiment are to cover all modifications, equivalents, and alternatives falling within the spirit and scope of the embodiments as defined by the following appended claims.

What is claimed is:

1. A device, comprising:

a base configured to be coupled to a storage segment of a pipe support assembly; and an arm configured to be coupled to the base, wherein the arm is disposed at a first location in a channel of the pipe support assembly to provide lateral support to a pipe when the pipe is disposed in a storage area adjacent to a first portion of the storage segment and disposed in the first location in the channel of the pipe support assembly when no pipe is disposed in the storage area, wherein the arm is configured to move in a horizontal direction from the first location in which an end of the arm is disposed at a first horizontal distance from the storage segment in the channel of the pipe support assembly to a second location in which the end of the arm is disposed at second horizontal distance from the storage segment in the channel of the pipe support assembly when a force greater than or equal to a predetermined level is applied to the arm, wherein the arm is configured to resiliently return to first location from the second location upon termination of application of the force greater than or equal to the predetermined level to be able to receive a second pipe.

2. The device of claim 1, wherein the arm is configured to move in a second horizontal direction opposite to the horizontal direction upon termination of application of the force greater than or equal to the predetermined level.

3. The device of claim 2, wherein the arm comprises a resilient material configured to move the arm in the second horizontal direction from the second location to the first location.

4. The device of claim 3, comprising at least one tension device coupled to the arm, wherein the at least one tension device is configured to provide a tension force to the arm to move the arm in the second horizontal direction from the second location to the first location.

5. The device of claim 1, wherein the arm is configured to move in the horizontal direction along the storage segment and into a second storage area adjacent to a second portion of the storage segment as the second location when acted upon by the force greater than or equal to the predetermined level.

6. The device of claim 1, wherein the arm is configured to move in the horizontal direction towards the storage segment as the second location when acted upon by the force greater than or equal to the predetermined level.

7. The device of claim 1, wherein the arm is coupled to the base as an integrated member.

8. The device of claim 1, wherein the arm and the base comprise the same material.

9. The device of claim 1, comprising a retention mechanism coupled to the arm.

10. The device of claim 9, wherein the retention mechanism is additionally coupled to the base, a fastener, a module housing the base, or the storage segment.

11. A system, comprising:

a module configured to be coupled to a storage segment of a pipe support assembly, wherein the module comprises:

a pipe retaining member disposed at a first location in a channel of the pipe support assembly when the pipe is disposed in a storage area adjacent to a first portion of the storage segment, wherein the pipe retaining member is disposed at the first location in the channel of the pipe support assembly when no pipe is disposed in the storage area, where the pipe retaining member provides lateral support to the pipe when the pipe is disposed in the storage area adjacent to the first portion of the storage segment, wherein the pipe retaining member is configured to move in a horizontal direction when a force greater than or equal to a predetermined level is applied to the pipe retaining member wherein the pipe retaining member is configured to resiliently return to the first portion of the storage segment upon termination of application of the force greater than or equal to the predetermined level to be able to receive a second pipe.

12. The system of claim 11, wherein the module comprises a second pipe retaining member configured to provide lateral support to the second pipe when the second pipe is disposed in a second storage area adjacent to a second portion of the storage segment.

13. The system of claim 12, wherein the second pipe retaining member is configured to move in the horizontal direction when the force greater than or equal to the predetermined level is applied to the pipe retaining member.

14. The system of claim 11, comprising:

a second module configured to be coupled to the storage segment of the pipe support assembly, wherein the second module comprises:

a second pipe retaining member configured to provide lateral support to the pipe when the pipe is disposed in the storage area adjacent to the first portion of the storage segment, wherein the second pipe retaining member is configured to move in a horizontal direction when a force greater than or equal to a predetermined level is applied to the second pipe retaining member.

15. The system of claim 11, wherein the pipe retaining member comprises a resilient material configured to return the pipe retaining member to the storage area adjacent to a first portion of the storage segment upon termination of application of the force greater than or equal to the predetermined level.

16. The system of claim 11, wherein pipe retaining member comprises circular or semi-circular shape.

17. A method, comprising:

moving a pipe from a storage location in a pipe support assembly to a second location outside of the pipe support assembly by:

applying a force to a pipe support member of the pipe support assembly to cause the pipe support member to move in a horizontal direction from a storage position in a channel of the pipe support assembly to a movement position in the channel of the pipe support assembly;

passing the pipe along a face of the pipe support member;

resiliently returning the pipe support member from the movement position to the storage position upon completion of passing the pipe along the face of the pipe support member to be able to receive a second pipe; and removing the pipe from the pipe support assembly.

18. The method of claim 17, comprising:

moving the second pipe from the second location outside of the pipe support assembly to the storage location in the pipe support assembly by:

applying the force to the pipe support member of the pipe support assembly to cause the pipe support member to move from the storage position in a second horizontal direction opposite to the horizontal direction;

passing the second pipe along a second face of the pipe support member; and releasing the second pipe into the pipe support assembly.

* * * * *